US005356519A

United States Patent [19]

Grabscheid et al.

[11] Patent Number: 5,356,519

[45] Date of Patent: Oct. 18, 1994

[54] SUPPORT BEAM MADE OF COMPOSITE FIBER MATERIAL

[75] Inventors: Joachim Grabscheid, Heuchlingen; Thomas Appels, Kühlenthal, both of Fed. Rep. of Germany

[73] Assignee: J.M. Voith GmbH, Heidenheim, Fed. Rep. of Germany

[21] Appl. No.: 988,232

[22] Filed: Dec. 9, 1992

[30] Foreign Application Priority Data

Dec. 13, 1991 [DE] Fed. Rep. of Germany ..... 4141133

[51] Int. Cl.[5] ..... B31F 1/14

[52] U.S. Cl. ..... 162/281; 162/111; 15/256.51

[58] Field of Search ..... 15/256.51; 162/111, 162/281

[56] References Cited

U.S. PATENT DOCUMENTS 3,134,126 5/1964 Phillips ..... 15/256.51
3,800,357 4/1974 Skytta ..... 15/256.51
4,789,432 12/1988 Goodnow ..... 162/281

FOREIGN PATENT DOCUMENTS 9113542.7 7/1992 Fed. Rep. of Germany .

*Primary Examiner*—W. Gary Jones
*Assistant Examiner*—Dean T. Nguyen
*Attorney, Agent, or Firm*—Baker & Daniels

[57] ABSTRACT

The present invention is directed to a support beam for a scraper blade which is in contact with the shell surface of a drying cylinder. The support beam comprises an oblong hollow body made of a fiber composite material wherein the major fiber orientation is essentially in the longitudinal expanse of the hollow body. The hollow body has at least two longitudinal walls of convex curvature as well as two transition sections of convex rounding which connect the longitudinal walls to one another. The radius of curvature of each longitudinal wall is greater than its width while the radius of curvature of each transition zone is smaller than the width of an adjacent longitudinal wall.

16 Claims, 3 Drawing Sheets

SUPPORT BEAM MADE OF COMPOSITE FIBER MATERIAL

BACKGROUND OF THE INVENTION

The present invention concerns a support beam for at least one oblong tool, for instance for a scraper blade or for two scraper blades.

A support beam of a type to which the present invention is directed is a so-called scraper beam. It forms together with the scraper blade(s) a so-called scraper intended for use in a machine for the production or processing of fibrous webs, for instance paper webs. The scraper blade can interact, e.g., directly with the shell surface of a rotating roll or of a drying cylinder in order to keep the shell surface clean or to pick the paper web off the shell surface. In paper coaters, the scraper bar makes direct contact with the paper web in order to remove surplus coating mixture.

U.S. Pat. No. 3,134,126 describes the problem that the major part of the scraper beam, i.e., the primarily box-shaped oblong hollow body, may sometimes flex, so that the scraper bar will (across its length) not be forced on the roll with a uniform line force. This flexure is caused in that one of the length walls of the hollow body assumes during operation a temperature higher than that of another length wall. To solve this problem, channels are provided inside the hollow body of the prior scraper beam. A tempering fluid flows through the channels. The objective is keeping the hollow body isothermal, thus avoiding the mentioned flexure. This prior design requires a high construction expense and complex control systems intended to safeguard the desired success.

U.S. Pat. No. 3,800,357 describes the same problem. As a solution to the problem, it provides for the following, based on a cross section of the scraper beam. An elastic support arm supports, on the one end, the scraper blade while, with its other end, it is mounted on the scraper beam. The latter has a drop type cross-sectional shape, i.e., it is a welded structure of two length walls with a convex curvature, their radius of curvature being greater than their width. Formed along one of the welds is an acutely angled edge extending at a relatively small distance from the scraper blade. This accomplishes that the scraper blade—less so than with a conventional beam design—participates in a thermally caused flexure of the beam. However, a completely uniform line force is still not achieved between scraper blade and roll, since the cause (namely the thermal beam flexure) has not been eliminated.

German utility patent application G 91 13 542.7 proposes to fabricate the oblong hollow body of the scraper beam of a fiber composite material in which the coefficient of thermal expansion resides in the so-called major fiber orientation near the value of zero and where the major fiber orientation extends approximately parallel to the longitudinal axis of the scraper beam. The hollow body favorably is to be made of a plastic reinforced with carbon fibers. Due to these measures, the hollow body can be kept free of flexure in a way simpler than according to U.S. Pat. No. 3,134,126, even if its length walls assume in the operation different temperatures. At the same time, as compared to steel, a lower weight is achieved in known fashion, along with a relatively high rigidity, i.e., reduced deadweight flexure at same dimensions.

Problematic of German patent application G 91 13 542.7, however, is the conventional design of the hollow body length walls as flat walls. Due to the major fiber orientation in the longitudinal direction, the rigidity of the hollow body is relatively low in peripheral direction. Hence, the safety against vibrations (the so-called panel vibration) and/or denting is insufficient with the flat length walls. Besides, the flat length walls are jeopardized by mechanical shock loads, for instance in the shipping or assembly of the scraper beam.

Underlying the present invention, therefore, is the problem of designing quite generally a support beam whose major part (the said hollow body) is to be made of a composite fiber material in such a way that the longitudinal walls of the hollow body—despite the major fiber orientation extending for the most parallel to its longitudinal axis—are sufficiently rigid, so that especially a sufficient denting safety will be given. Another part of the problem definition is that the known, extensively box type shape of the support beam (e.g., with a mostly triangular cross section) is to be retained to the maximum extent, due to its known high flexural and torsional strength.

SUMMARY OF THE INVENTION

The present invention provides a support beam for a paper machine having an oblong hollow body including at least two longitudinal walls with a convex curvature. The convex curvature defines a radius of curvature which is greater than the width of each of the longitudinal walls. The hollow body is made of a composite fiber material having a major fiber orientation extending essentially in the longitudinal expanse of the hollow body. The longitudinal walls are joined exclusively to each other by means of transition zones having a radius of curvature which is smaller than the width of an adjacent longitudinal wall. Since the oblong hollow body—viewed in cross section—has longitudinal walls which feature a slight convex curvature and are joined to one another exclusively by transitional zones with a convex rounding (that is, avoiding any sharp edges), the following advantage is achieved. The longitudinal walls—despite their relatively slight wall thickness—obtain in peripheral direction a high flexure strength. They are thus extremely insensitive to vibrations and mechanical shock load. Specifically, the length walls have a high denting resistance. All of this applies despite making the hollow body of a fiber composite material with a mostly longitudinal fiber orientation.

According to an important further aspect of the invention, the oblong hollow body of the support beam is no longer an essentially integral component as before (refer, e.g., to U.S. Pat. Nos. 3,134,126 or 4,789,432) including a flange type slat molded to it and supporting the tool, for instance the scraper blade. Instead, this slat (or several slats, as the case may be) is preferably fashioned as a component separate from the hollow body, as known as such from U.S. Pat. No. 3,800,357. The fabrication of the hollow body of the fiber composite material—thus, at first without the slat—is considerably facilitated thereby, especially if the hollow body is to have a great length (in the order 10 m). Separately made, the slat (or slats) is then fastened to the hollow body by means of suitable fasteners. In variation thereof, however, it is also possible to fabricate the hollow body and the slat jointly as an integral component of composite fiber material.

In all of these embodiments of the invention, the oblong hollow body may have an essentially polygonal, e.g., triangular or square, cross section. In this case, three or four longitidinal walls exist each having a slight convex curvature. Also possible is an oval cross section, though, so that only two longitudinal walls with a slight convex curvature exist, which are joined (as in the other embodiments) by transitional zones of convex rounding.

If the aforementioned slat (or slats) is fabricated independently of the hollow body of the support beam, there are various options for joining the slat (or slats) to the hollow body. If the slat is made, e.g., of a metallic material, provisions must be made which allow the slat to expand or contracted at temperature fluctuations in the longitudinal direction relative to the hollow body. Hence, fasteners must be used which allow such longitudinal movements of the slat. The same applies when several slats of this type are used.

According to a further aspect of the invention, however, the separate fabrication of the slat (or slats) is preferred, again from composite fiber material. Here, the fiber share and the major fiber orientation can be selected such that the thermal expansion in longitudinal direction—the same as with the hollow body—is near zero. In other words, provisions will be that the thermal expansion of the slat(s) equals maximally the thermal expansion of the hollow body. This can be realized especially well in that carbon or graphite fibers are used as reinforcing fiber component for both the slat and the hollow body. Similarly, the tool (for example a scraper blade) and/or the tool holder will be so fashioned that it undergoes the same longitudinal thermal expansion as the slat(s), or a type of mounting will be chosen which allows the longitudinal movement of the tool and/or holder relative to the slat.

The components can be fabricated using processes known to the expert from the prior art, such as the filament winding technique or the laying technique of preimpregnated webs, for instance, retroactive impregnation or coating of the basic element with synthetic resin and subsequent curing, as the case may be with the application of temperature and pressure.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
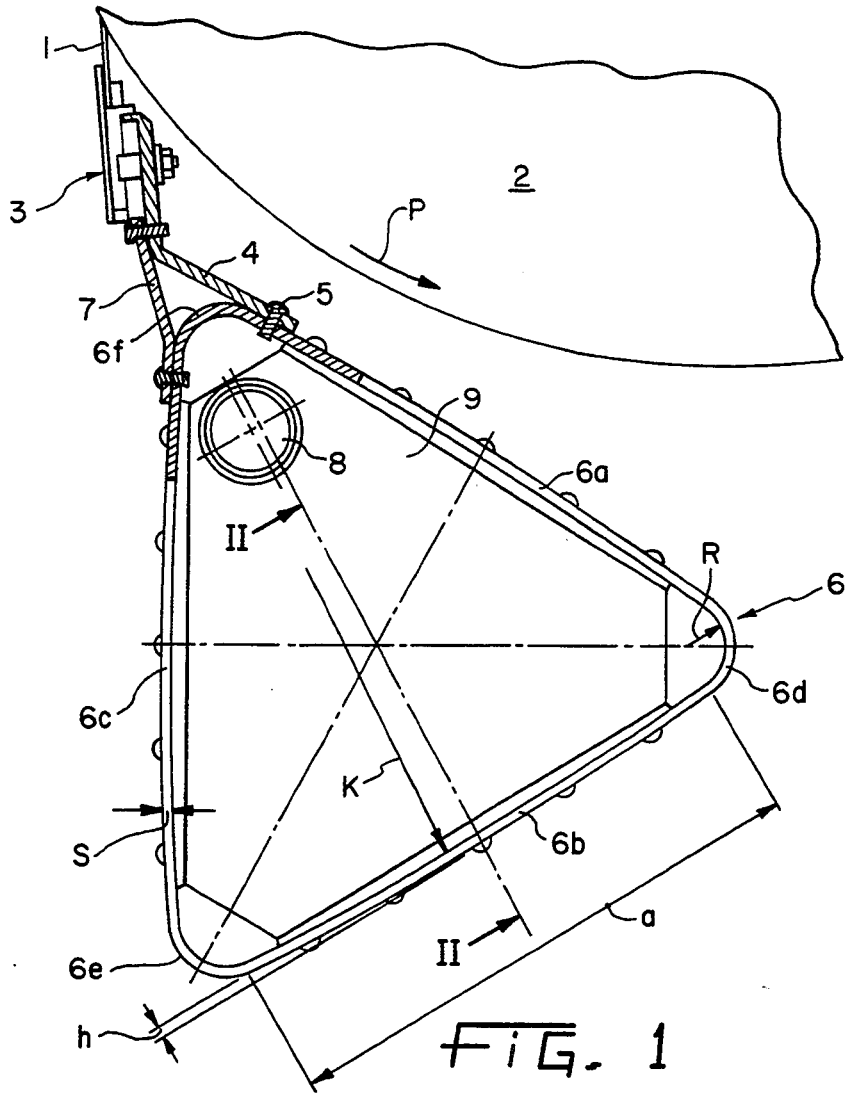
FIG. 1 is a partial side view in partial cross section of a scraper according to one embodiment of the present invention.

FIG. 1 shows a so-called pick-up scraper whose blade 1 is in contact with the outer shell surface of a drying cylinder 2, the direction of rotation of which is indicated by an arrow P. The pickup scraper serves to clean the shell surface of the drying cylinder 2 and, as the case may be, to pick up a paper web which approaches the scraper blade 1. The scraper blade 1 is fastened to an angles slat 4 by means of a holding and pivoting device marked 3 overall. This slat 4, in turn, is by means of screws 5, attached to a hollow body marked 6 overall. For reinforcement, an additional slat 7 is provided which, for one, is screwed to the angled slat 4 and, for another, as well to the hollow body 6. The latter and the slats 4 and 7 form together a support beam for the scraper blade 1 (or for another oblong tool) and for the pertaining holding and pivoting device 3.

Figure 2:
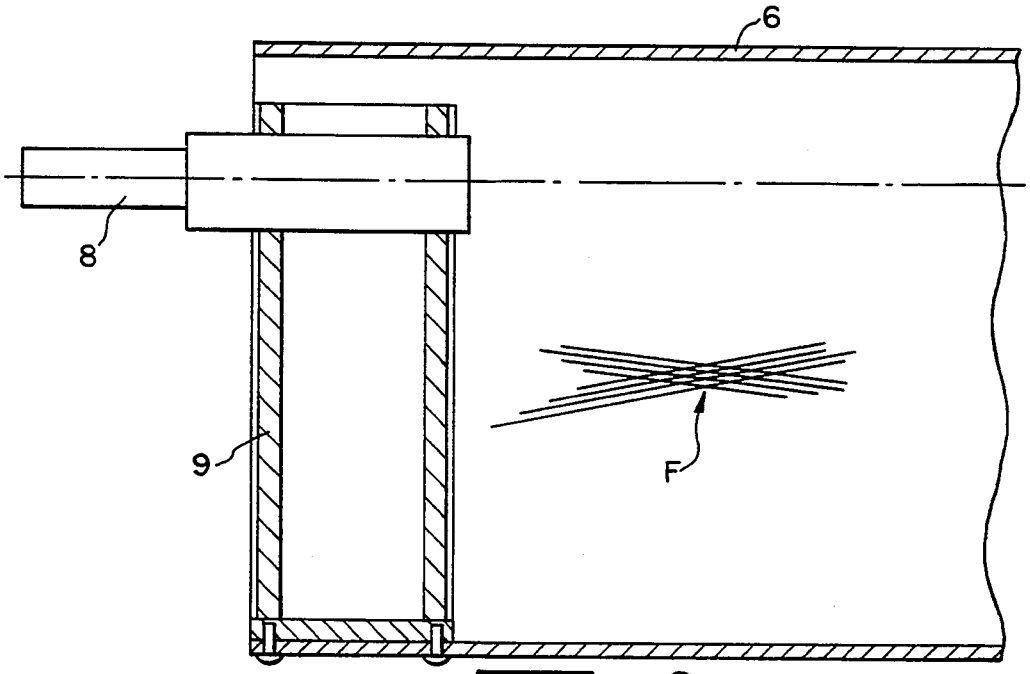
FIG. 2 is a partial cross sectional view taken along line II—II in FIG. 1.

All of the components named so far are parts, e.g., of a paper machine. They all have a longitudinal expanse (perpendicular to the drawing plane of FIG. 1) in the so-called machine cross direction. The hollow body 6, in rough approximation, has a triangular cross section. It has thus three longitudinal walls 6*a*, 6*b* and 6*c* which extend as well in the machine cross direction and may assume different temperatures during operation. Therefore, they are made of a fiber composite material in which the major fiber orientation is at least approximately in the longitudinal direction, that is, as well transverse to the machine direction. This is indicated by F in FIG. 2.

The longitudinal walls 6*a*, 6*b* and 6*c* have a slight convex curvature and form together with transition sections 6*d*, 6*e* and 6*f* with a convex rounding an integral, oblong component, namely the aforementioned hollow body 6.

In the embodiment illustrated in FIG. 1, all three longitudinal walls have the same width a. This facilitates the fabrication of the hollow body 6. However, a variation thereof is possible, if required. The radius of curvature (K) of each longitudinal wall (for instance 6*a*) is considerably greater than its width a. The radius of curvature K is generally chosen in such a way that the so-called rise h ranges in the order of 1/100 of the width a. In the same order (1 to 2/100 of the width a) ranges also the wall thickness as of the hollow body 6. The radius of curvature R of the transition sections 6*d*, 6*e* and 6*f* ranges approximately at 1/10 of the width a.

The slats 4 and 7 supporting the holding and pivoting device for the scraper blade 1 are made of a fiber composite material which in terms of thermal expansion in longitudinal direction (i.e., in machine cross direction) has the same properties as the hollow body 6.

Inserted in the hollow body 6, on each end, is a so-called beam cap 9. Its outer contour is adapted to the convex curvature of the longitudinal walls 6*a*, 6*b*, 6*c*, so that the cap can be screwed to the hollow body 6. Each of the beam caps, of which only one is visible and preferably made of steel, has a welded journal 8 extending in the longitudinal direction. The journals 8 serve in known fashion to support the scraper in stationary bearings, which have been omitted in the drawings. If necessary, the scraper can pivot in the bearings.

Figure 3:
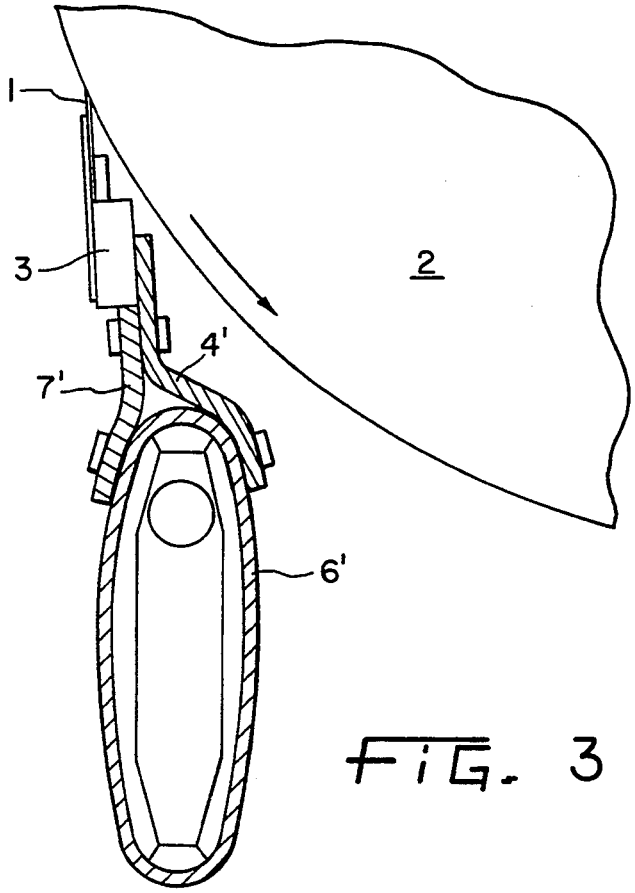
FIGS. 3, 4, and 5 are alternative embodiments of the scraper according to the invention.

The embodiment according to FIG. 3 has again a scraper blade 1, a holding and pivoting device 3, along with slats 4' and 7' and a hollow body 6'. The essential difference from FIG. 1 is constituted in that the hollow body 6' has an approximately oval cross section.

Figure 4:
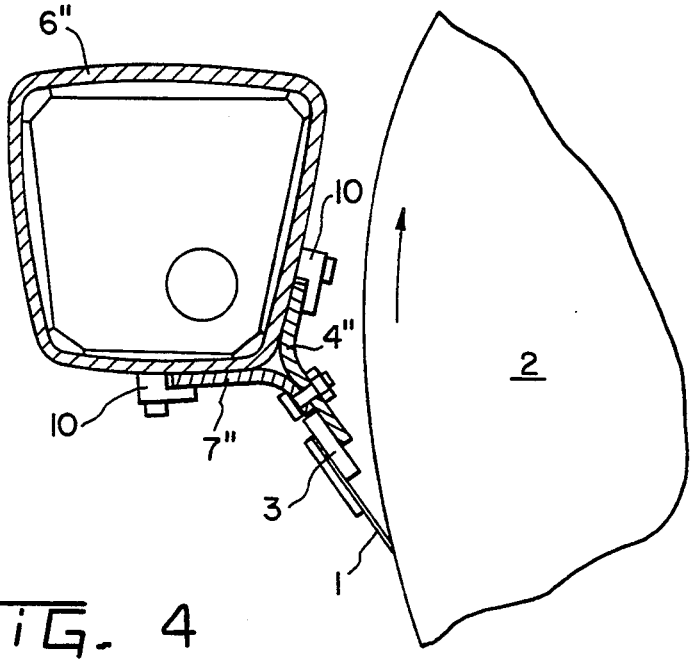

According to the embodiment relative to FIG. 4, a hollow body 6'' is provided which now, in coarse approximation, has a square cross section and is made again of a fiber composite material. Two slats 4'' and 7'' are provided again for joining the hollow body 6″ with the holding and pivoting device 3 of the scraper blade 1. Varying from FIG. 1, these slats are made of steel. Therefore, they are not screwed to the hollow body 6″. Rather, there are clamping elements 10 provided which, in turn, are screwed to the hollow body 6″ and allow a longitudinal expansion of the slats 4″ and 7″ relative to the hollow body 6″.

Figure 5:
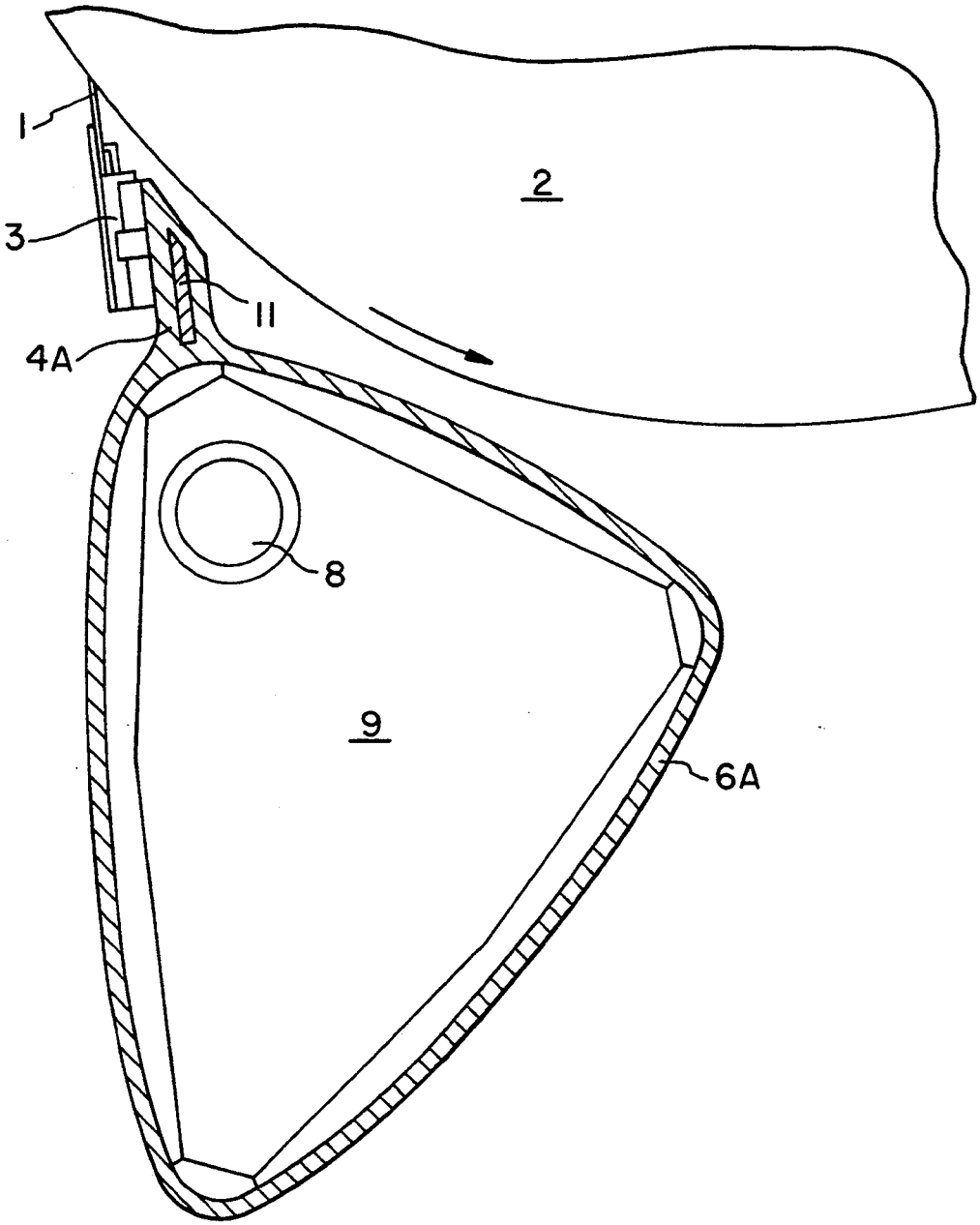

Illustrated in FIG. 5 is an embodiment in which the hollow body 6A and the slat 4A jointly form an integral component made of fiber composite material. If required, a reinforcement element 11 can be embedded in the interior of the slat 4A. The three length walls of the hollow body 6A differ in width (varying from FIG. 1) in FIG. 5.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A support beam for at least one scraper blade adapted for interaction with the shell-surface of a roll or drying cylinder of a machine for the production or processing of fibrous webs, said support beam comprising:

an oblong hollow body having at least two longitudinal walls with a convex curvature, said convex curvature defining a radius of curvature greater than a width of each longitudinal wall, said hollow body comprising a composite fiber material having a major fiber orientation extending essentially in the longitudinal direction of said hollow body, said longitudinal walls of said hollow body joined exclusively by means of transition sections having a radius of curvature which is smaller than the width of an adjacent longitudinal wall.

2. A support beam according to claim 1, further comprising at least one slat supporting said scraper blade, said hollow body and said slat being separate components.

3. A support beam according to claim 2, wherein said slat comprises a composite fiber material having a thermal expansion in the longitudinal direction at least approximately equal to the thermal expansion of said hollow body in the longitudinal direction.

4. A support beam according to claim 2, further comprising clamping elements, said slat attached to said hollow body by said clamping elements, said clamping elements allowing a longitudinal expansion of said relative to said hollow body.

5. A support beam according to claim 2, wherein said at least one slat comprises at least two slats, said at least two slats connected to said hollow body and to each other.

6. A support beam according to claim 2, wherein at least one of said hollow body and said slat comprise one of carbon or graphite as reinforcing fibers.

7. A support beam according to claim 1, wherein said hollow body has a generally triangular cross sectional shape.

8. A support beam according to claim 7, wherein said hollow body comprises these longitudinal walls, each said longitudinal wall approximately having a same width.

9. A support beam according to claim 1, wherein said hollow body has a generally oval cross sectional shape.

10. A support beam according to claim 1, wherein said hollow body comprises at each interior end thereof, a beam cap having a support element.

11. A support beam according to claim 10, wherein said beam caps are only attached to said longitudinal walls.

12. A support beam according to claim 10, wherein said support element comprises a journal, at least one of said beam caps and said journals comprising a material having a modulus of elasticity higher than that of said hollow body.

13. A support beam according to claim 1, further comprising at least one slat supporting said support beam, said hollow body and said slat defining an integral component made of composite fiber material.

14. A support beam according to claim 1, wherein said hollow body comprises carbon or graphite as reinforcing fibers.

15. In combination, a shell surface of a roll for a machine used in the production of fibrous webs, a scraper blade interacting with said shell surface, and a support beam attached to said scraper blade, said support beam comprising:

an oblong hollow body having at least two longitudinal walls with a convex curvature, said convex curvature defining a radius of curvature greater than a width of each longitudinal wall, said hollow body comprising a composite fiber material having a major fiber orientation extending essentially in the longitudinal direction of said hollow body, said longitudinal walls of said hollow body joined exclusively by means of transition sections having a radius of curvature which is smaller than the width of an adjacent longitudinal wall.

16. In combination, a shell surface of a drying cylinder for a machine used in the production of fibrous webs, a scraper blade interacting with said shell surface, and a support beam attached to said scraper blade, said support beam comprising:

an oblong hollow body having at least two longitudinal walls with a convex curvature, said convex curvature defining a radius of curvature greater than a width of each longitudinal wall, said hollow body comprising a composite fiber material having a major fiber orientation extending essentially in the longitudinal direction of said hollow body, said longitudinal walls of said hollow body joined exclusively by means of transition sections having a radius of curvature which is smaller than the width of an adjacent longitudinal wall.

* * * * *